US010808977B2

(12) United States Patent
Schoonen

(10) Patent No.: US 10,808,977 B2
(45) Date of Patent: Oct. 20, 2020

(54) REFRIGERATION APPARATUS WITH A VALVE

(71) Applicant: Franke Technology and Trademark Ltd, Hergiswil (CH)

(72) Inventor: Wilhelmus Franciscus Schoonen, BA Son (NL)

(73) Assignee: Franke Technology and Trademark Ltd, Hergiswil (CH)

( * ) Notice: Subject to any disclaimer, the term of this patent is extended or adjusted under 35 U.S.C. 154(b) by 107 days.

(21) Appl. No.: 16/074,576

(22) PCT Filed: Feb. 4, 2016

(86) PCT No.: PCT/EP2016/052374

§ 371 (c)(1),
(2) Date: Aug. 1, 2018

(87) PCT Pub. No.: WO2017/133774

PCT Pub. Date: Aug. 10, 2017

(65) Prior Publication Data

US 2019/0032982 A1 Jan. 31, 2019

(51) Int. Cl.
*F25B 49/02* (2006.01)

(52) U.S. Cl.
CPC ..... *F25B 49/027* (2013.01); *F25B 2500/19* (2013.01); *F25B 2600/2513* (2013.01); *F25B 2700/04* (2013.01)

(58) Field of Classification Search
CPC ..... F25B 49/027; F25B 2500/19; F25B 2600/2513; F25B 2700/04
See application file for complete search history.

(56) References Cited

U.S. PATENT DOCUMENTS 4,537,042 A * 8/1985 Nishi ..... B60H 1/3216 62/208
5,201,190 A * 4/1993 Nelson ..... F25B 41/04 62/210

(Continued)

FOREIGN PATENT DOCUMENTS

DE 102012204057 9/2013
GB 1247580 9/1971

(Continued)

OTHER PUBLICATIONS

Mader, A Method of controlling operation of a vapour compression system, Mar. 30, 2010, Full Document (Year: 2010).*

(Continued)

*Primary Examiner* — Elizabeth J Martin
*Assistant Examiner* — Nael N Babaa
(74) *Attorney, Agent, or Firm* — Volpe and Koenig, P.C.

(57) ABSTRACT

A refrigeration apparatus for refrigerating a fluid is disclosed. The apparatus includes a refrigerant, a compressor (301), a condenser (302), an expansion device (304), and an evaporator (305), fluidly connected to form a refrigeration cycle, a controllable valve (303) configured to control a flow of the refrigerant from the condenser (302) to the evaporator (305), at least one sensor (330) configured to measure a property of the refrigerant, and a controller (300) configured to determine an amount of the refrigerant stored in a portion of the refrigeration cycle including the condenser (302), and to control the controllable valve (303) based on the determined amount of the refrigerant.

13 Claims, 5 Drawing Sheets

(56) References Cited

U.S. PATENT DOCUMENTS

| | | | | |
|---|---|---|---|---|
| 2015/0168024 | A1* | 6/2015 | Lee | F25B 49/02 62/117 |
| 2015/0354875 | A1* | 12/2015 | Fuller | F25B 13/00 62/498 |

FOREIGN PATENT DOCUMENTS

| | | | | |
|---|---|---|---|---|
| JP | 2000227259 | | 8/2000 | |
| KR | 20140048620 | | 4/2014 | |
| WO | 2010118745 | | 10/2010 | |
| WO | WO-2010118745 | A2 * | 10/2010 | F25B 49/027 |

OTHER PUBLICATIONS

Lars, A method of controlling operation of a vapour compression system, 2010, Full Document (Year: 2010).*

* cited by examiner

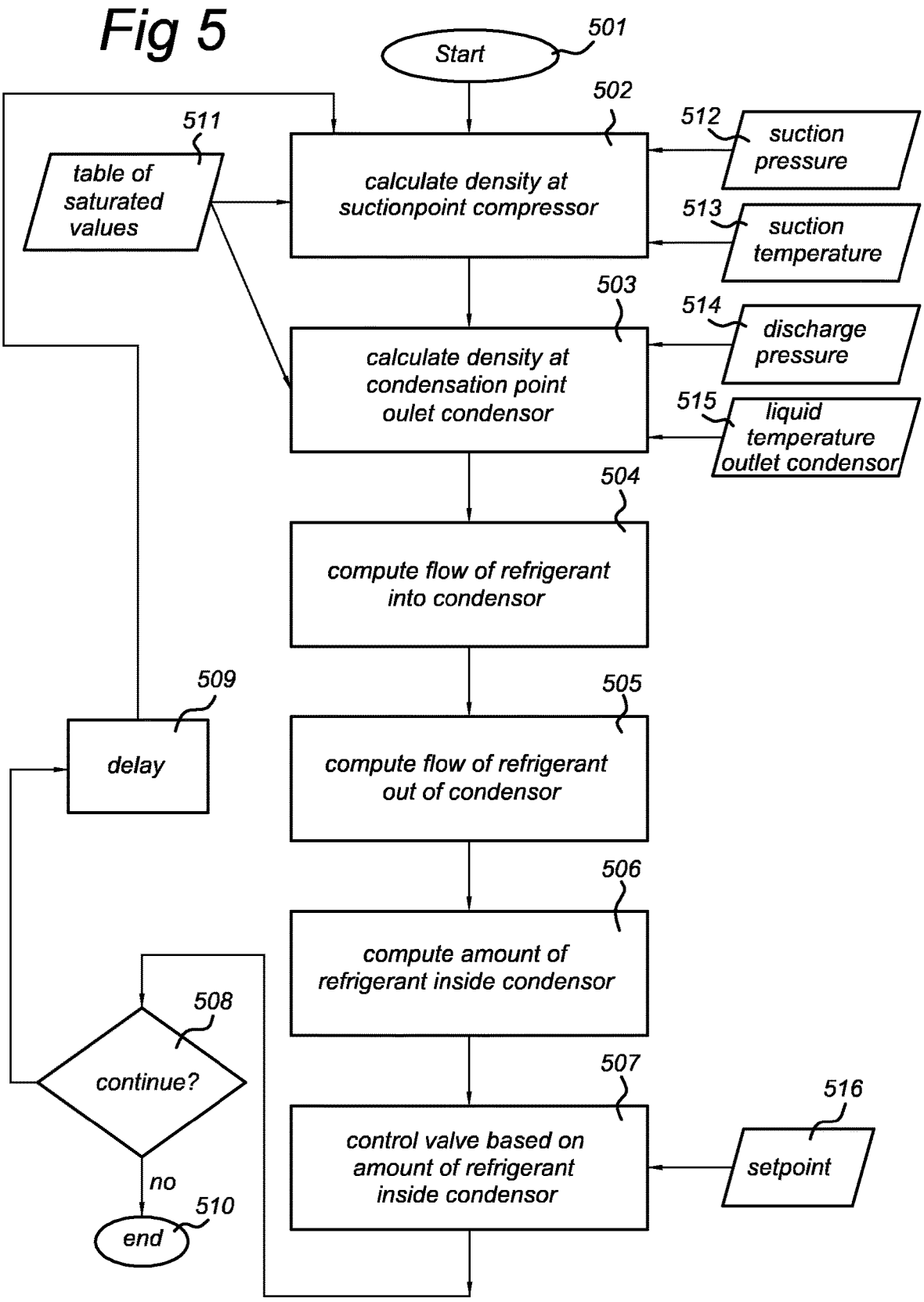
Fig 5
Start
501
502
calculate density at suctionpoint compressor
511
table of saturated values
512
suction pressure
513
suction temperature
503
calculate density at condensation point oulet condensor
514
discharge pressure
515
liquid temperature outlet condensor
504
compute flow of refrigerant into condensor
505
compute flow of refrigerant out of condensor
506
compute amount of refrigerant inside condensor
507
control valve based on amount of refrigerant inside condensor
516
setpoint
509
delay
508
continue?
no
510
end

REFRIGERATION APPARATUS WITH A VALVE

FIELD OF THE INVENTION

The invention relates to a refrigeration apparatus and to a method of operating a refrigeration apparatus.

BACKGROUND OF THE INVENTION

A refrigerating apparatus can be used, e.g. as a fluid cooler to cool a liquid such as water, a consumable liquid such as lemonade or beer, or another fluid. Such fluid coolers are widely employed in industry, household appliances, drinking establishments, restaurants as for example fast food restaurants, catering industry, etc. The fluid refrigerated by the fluid cooler often should be dispensed, for example in a glass. In this kind of industry, it is known to use fluid coolers including a refrigerating vessel comprising a tube containing refrigerant that goes through the inside of the refrigerating vessel. In this way, a cooling liquid, such as water, can be stored inside of the refrigerant vessel; and the refrigerant that flows through the tube, can cool the water. The consumable liquid can be fed through another tube that is immersed in the cooled water. Also, the cooling liquid is sometimes circulated by means of a tubing, to cool several components of the installation, for example such tubing may be provided along a tube containing the consumable liquid from the refrigerating vessel to the tap and/or from a container of the consumable liquid to the refrigerating vessel. Also in other household and/or industrial applications, multiple cooling applications may be in use simultaneously.

GB 1247580 discloses a refrigerating system including a compressor, a condenser, a fluid line, and a cooling unit, wherein the cooling unit comprises an annular refrigerant chamber containing refrigerant.

DE 10 2012 204057 further discloses a heat exchanger comprising a cavity which is filled with refrigerant coming out of an evaporator in order to regulate the temperature of the refrigerant before conveying it to the condenser.

SUMMARY OF THE INVENTION

There is a need for an improved and more efficient cooling system. To address this concern, in a first aspect, a refrigeration apparatus for refrigerating a fluid is provided in accordance with one or more features of the invention. The apparatus comprises:

a refrigerant;

a compressor, a condenser, an expansion device, and an evaporator, fluidly connected to form a refrigeration cycle;

a controllable valve configured to control a flow of the refrigerant from the condenser to the evaporator;

at least one sensor configured to measure a property of the refrigerant;

a controller configured to receive from said at least one sensor information about the measured property, use said information to determine an amount of the refrigerant stored in a portion of the refrigeration cycle comprising the condenser, and control the controllable valve based on the determined amount of the refrigerant.

The above-defined apparatus can use the available amount of refrigerant very efficiently. By controlling the valve, based on the amount of refrigerant stored in the portion of the refrigeration cycle comprising the condenser, that amount of refrigerant can be controlled with high precision.

In particular applications, that amount of refrigerant can be kept small, or can be kept close to a predetermined set point, while the valve can be controlled to close the valve before the liquid phase refrigerant in the condenser is exhausted, thus improving operation of the refrigeration apparatus.

In a particular embodiment of the apparatus, the measured property may be temperature or pressure, or a combination thereof. One or more properties other than temperature or pressure may be measured instead of or in addition to temperature and/or pressure. Different sensors may be provided to measure different properties.

In a further embodiment, said at least one sensor may comprise a first sensor configured to measure a first property of the refrigerant in a first portion of the refrigeration cycle, the first portion of the refrigeration cycle being a portion from an outlet of the expansion device to an inlet of the compressor and the first portion including the evaporator. The first portion may correspond to a low-pressure part of the refrigeration cycle, wherein the pressure is lower than in a second portion of the refrigeration.

In yet another embodiment, said at least one sensor may further comprise a second sensor configured to measure a second property of the refrigerant in a second portion of the refrigeration cycle, the second portion of the refrigeration cycle being a portion from an outlet of the compressor to an inlet of the expansion device and including the condenser. The second portion may correspond to a high-pressure part of the refrigeration cycle, wherein the pressure is higher than in the first portion of the refrigeration cycle.

In a particularly advantageous embodiment, the controller may be further configured to receive information about a capacity at which the compressor is working and to determine said amount of the refrigerant further based on said information about the capacity at which the compressor is working. This information can be used to estimate e.g. the rate at which refrigerant is displaced by the compressor. It may comprise information about an electrical current consumed by the compressor and/or a know setting of the compressor, which provides an easy way of determining the compressor's working capacity.

The controller may, according to another embodiment of the apparatus, be configured to compute a displacement of refrigerant by the compressor and a throughput of refrigerant through the expansion device, and to compute the amount of refrigerant in the portion of the refrigeration cycle comprising the condenser based on the displacement and the throughput. This computation may be performed based on the pressure in the first portion and the pressure in the second portion. These pressures may be measured directly or, alternatively, may be computed from one or more other measured properties.

The controller may, according to yet another embodiment of the apparatus, be configured to control to open the controllable valve to allow the flow of the refrigerant from the condenser to the evaporator if the amount of refrigerant in the portion of the refrigeration cycle comprising the condenser exceeds a first predetermined threshold value, and control to close the controllable valve to prevent the flow of the refrigerant from the condenser to the evaporator if the amount of refrigerant in the portion of the refrigeration cycle comprising the condenser is below a second predetermined threshold value. This allows the keeping of the amount of refrigerant, such as the total mass of refrigerant inside the portion, in a certain predetermined range. This way it may be avoided that unnecessarily much refrigerant is collected in the condenser. Also, emptying of the condenser may be avoided.

According to another preferred embodiment, the first sensor may be configured to measure the first property of the refrigerant inside the evaporator or in a passage from the evaporator to the compressor, and the apparatus may further comprise a third sensor configured to measure a third property of the refrigerant in a passage from the expansion device to an inlet of the evaporator; wherein the controller is configured to determine an overheating condition based on the first property and the third property, and to control the controllable valve also based on the determined overheating condition. Such an overheating condition may be detected, for example, by comparing the first measured property and the third measured property.

The portion of the refrigeration cycle comprising the condenser may be a portion that extends from an outlet of the compressor to an inlet of the expansion device and including the condenser. Alternative definitions of the portion may be also be used, for example the condenser and the output line of the condenser up to the controllable valve or up to the expansion device.

The controllable valve may form, according to another embodiment, at least a part of the expansion device. This allows the use of a valve with an expansion function.

In a second aspect of the present invention, the above-defined object is also achieved by a method of operating a refrigeration apparatus having one or more features of the invention. The method comprises:

providing a refrigerant;

providing a compressor, a condenser, an expansion device, and an evaporator, fluidly connected to form a refrigeration cycle;

providing a controllable valve configured to control a flow of the refrigerant from the condenser to the evaporator;

providing at least one sensor configured to measure a property of the refrigerant;

using the measured property to determine an amount of the refrigerant stored in a portion of the refrigeration cycle comprising the condenser, and controlling the controllable valve based on the determined amount of the refrigerant.

The person skilled in the art will understand that the features described above may be combined in any way deemed useful. Moreover, modifications and variations described in respect of the system may likewise be applied to the method and to the computer program product, and modifications and variations described in respect of the method may likewise be applied to the system and to the computer program product.

BRIEF DESCRIPTION OF THE DRAWINGS

In the following, aspects of the invention will be elucidated by means of examples, with reference to the drawings. The drawings are diagrammatic and may not be drawn to scale. Similar items may be denoted by the same reference numerals throughout the figures.

FIG. 5 shows a flowchart of a method of operating a refrigeration apparatus.

DETAILED DESCRIPTION OF THE EMBODIMENTS

In the following, example implementations will be described in more detail with reference to the drawings. However, it will be understood that the details described herein are only provided as examples to aid an understanding of the invention and not to limit the scope of the disclosure. The skilled person will be able to find alternative embodiments which are within the spirit and scope of the present invention as defined by the appended claims and their equivalents.

Figure 1:
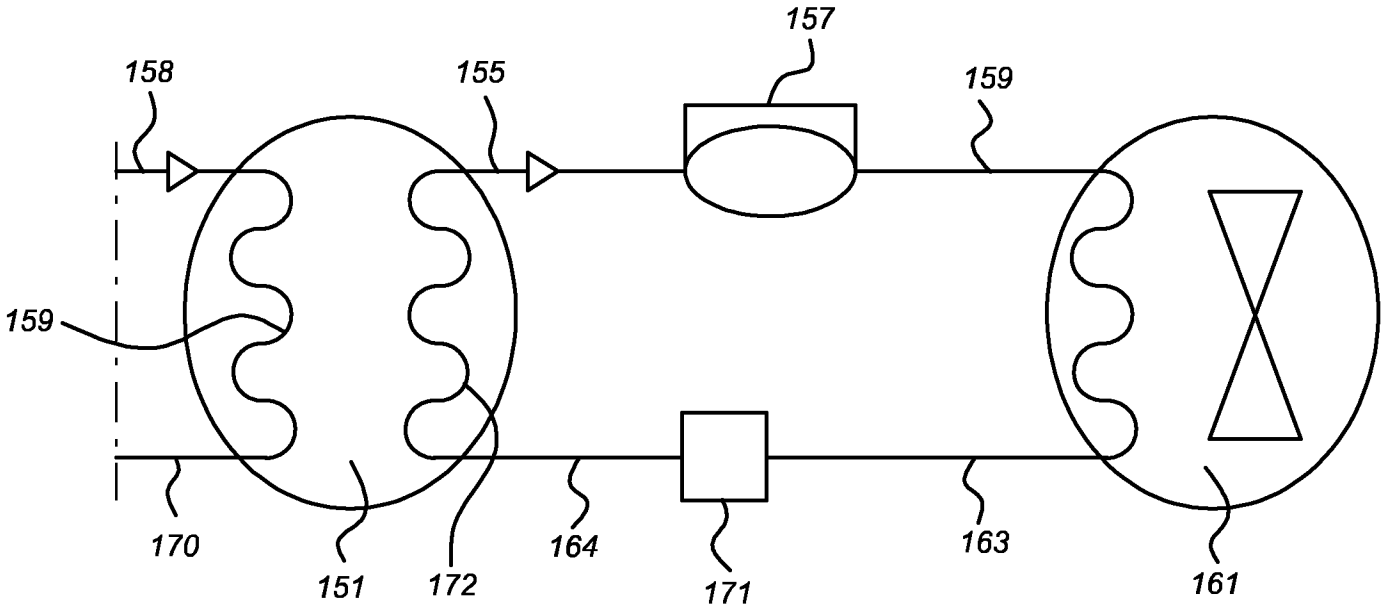
FIG. 1 shows a diagram of a related refrigeration apparatus.

FIG. 1 shows a diagram of a generic cooling system or refrigeration apparatus capable of cooling a fluid. During operation, a refrigerant is circulated through the apparatus in a refrigeration cycle. The refrigerating system of FIG. 1 comprises an evaporator 151, a compressor 157, a condenser 161, and an expansion device 171. The evaporator 151 may be any evaporator known in the art. Likewise, the compressor 157, the condenser 161, and the expansion device 171 may be as known in the art.

The refrigerating system of FIG. 1 may comprise furthermore a fluid input tube 158 and a fluid output tube 170, which may be fluidly connected by a tube 159 inside the evaporator 151. During operation, a fluid to be cooled may be caused to flow through the tube 159 so that the fluid to be cooled exchanges heat with the refrigerant, which may flow through tube 172 of the evaporator. In certain embodiments, both the tube 159 and the tube 172 are immersed in a vessel inside the evaporator 151, which vessel (not shown) comprises a liquid such as water, so that the heat exchange takes place via this liquid. In certain other embodiments, the tube 159 may be replaced by a vessel containing the fluid to be cooled and the tube 172 is disposed inside this vessel. In certain other embodiments, the tube 172 may be replaced by a vessel containing the refrigerant and the tube 159 is disposed inside the vessel. Other implementations of the evaporator are also possible.

The refrigerating system may further comprise a suction line 155. One of the ends of the suction line 155 may be fluidly connected to tube 172 of the evaporator 151 and arranged to allow the flow of the refrigerant out of the evaporator 151 to the compressor 157. The other end of the suction line 155 may be operatively connected to the compressor 157. The compressor 157 may be arranged to cause a flow of the refrigerant from the evaporator 151 to the compressor 157 through the suction line 155. The compressor 157 may be arranged to compress the refrigerant received from the suction line 155. The refrigerating system may further comprise a discharge line 159 fluidly connecting the compressor 157 to the condenser 161 and arranged to allow a flow of the compressed refrigerant from the compressor 157 to the condenser 161. The condenser 161 may be arranged to condense the compressed refrigerant received from the compressor. The condenser 161 may be any suitable condenser known in the art. In certain embodiments, the evaporator 151 may be arranged to be filled with a liquid to be cooled while a refrigerant may pass through a tube placed inside of the evaporator in such a way that the tube filled with refrigerant traverses the liquid to be cooled thereby refrigerating the liquid.

Figure 2A:
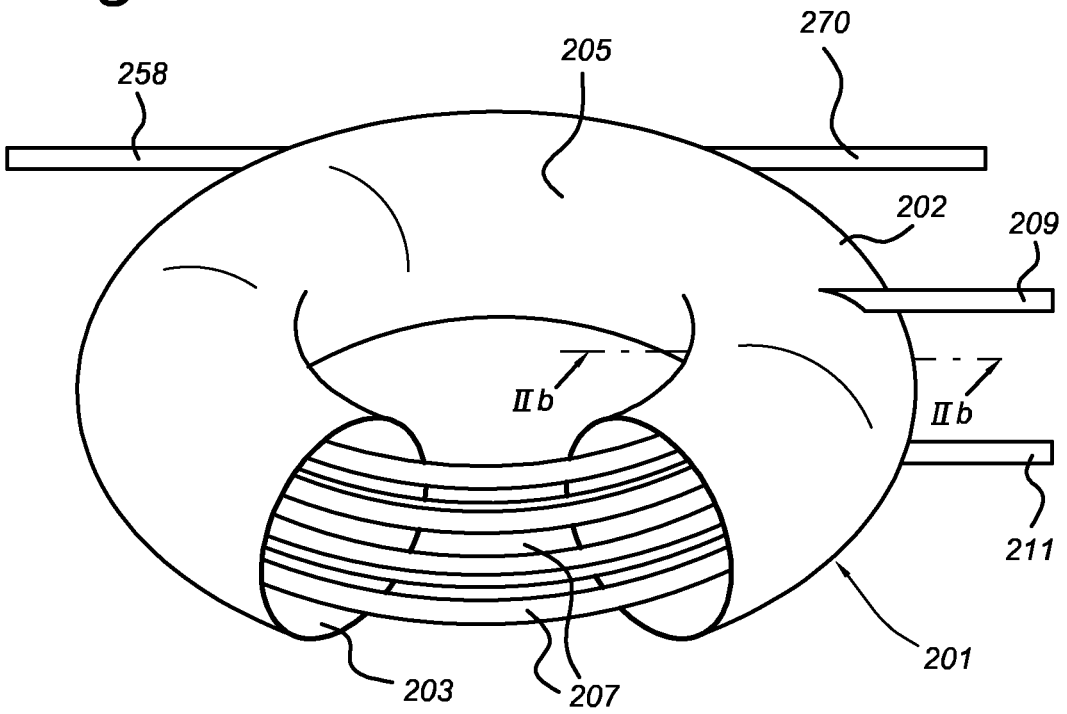
FIG. 2A shows a partly worked open view of a heat exchanger for refrigerating a fluid.

In certain embodiments, the evaporator 151 may be arranged to be filled with refrigerant while a liquid to be cooled may passed through a tube placed inside of the evaporator in such a way that the tube filled with the liquid to be cooled traverses the refrigerant thereby being refrigerated. FIG. 2A illustrates an example of an evaporator working in this way.

FIG. 2A shows a partly worked open view of a heat exchanger for refrigerating a fluid, which can act as the evaporator in a refrigeration cycle. The heat exchanger comprises a vessel 201 for containing the refrigerant. The vessel 201 has a chamber 203 with an inlet 211 and an outlet 209 for transport of the refrigerant into and out of the chamber 203. The tube 207 corresponds to the tube 159 of FIG. 1 and is used to transport the fluid to be cooled through the evaporator. While traveling through the tube 159, the fluid to be cooled exchanges heat with the refrigerant inside the chamber 203 through the wall of the tube 159. A fluid input tube 258 and a fluid output tube 270 for the fluid to be cooled are also shown in the figure. The tube 207 may be arranged in at least one turn around an inner wall 205 of the vessel 201 or the chamber 203. However, the tube 207 may be arranged with a plurality of turns around the inside wall 205, in a coil shape. The plurality of turns may be any suitable number such that the tube is arranged to occupy a predetermined amount of a volume of the inner space 203. However, this is not a limitation. For instance, the tube may be arranged to occupy at least two thirds of the volume of the inner space. Alternatively, the tube may have any size.

In the example shown in FIG. 2A, the vessel has a toroid or 'donut' shape. This allows filling the chamber 203 with tubing 207 efficiently without making sharp turns in the tube 207. The suction line 209 connects the chamber to the compressor 157 and the tube 211 fluidly connects the chamber to the expansion device. However, the evaporator is not limited to any particular shape in the context of the present invention.

Figure 2B:
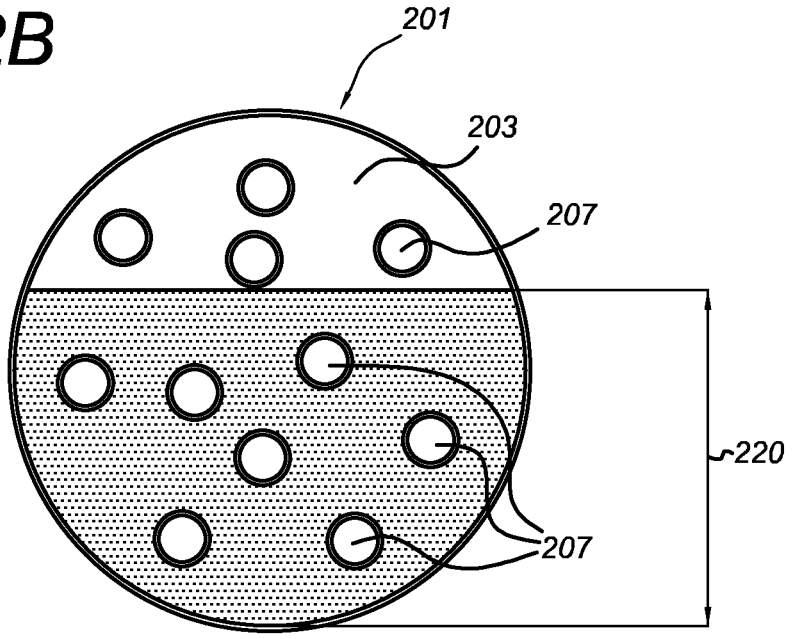
FIG. 2B shows a cross section of the heat exchanger of FIG. 2A.

FIG. 2B shows a cross section in longitudinal direction of a part of the heat exchanger for refrigerating a fluid of FIG. 2A. The tube 207 going through the inner space 203 in several windings around the inner wall 205 is illustrated. The inner space 203 may be filled with liquid refrigerant up to a level illustrated at reference numeral 220 in FIG. 2B. The remainder of the inner space 203 may be filled with gaseous refrigerant, i.e., the refrigerant in its gaseous form. The level 220 of the liquid refrigerant may be chosen according to the application needs.

It may be desirable to have as much refrigerant as possible in the evaporator, because in that way the liquid to be cooled can be refrigerated more efficiently. On the other hand, it may be desirable to have as little refrigerant as possible outside of the evaporator, because the portion of the refrigerant that is outside of the evaporator does not contribute to the cooling of the fluid to be cooled.

Figure 3:
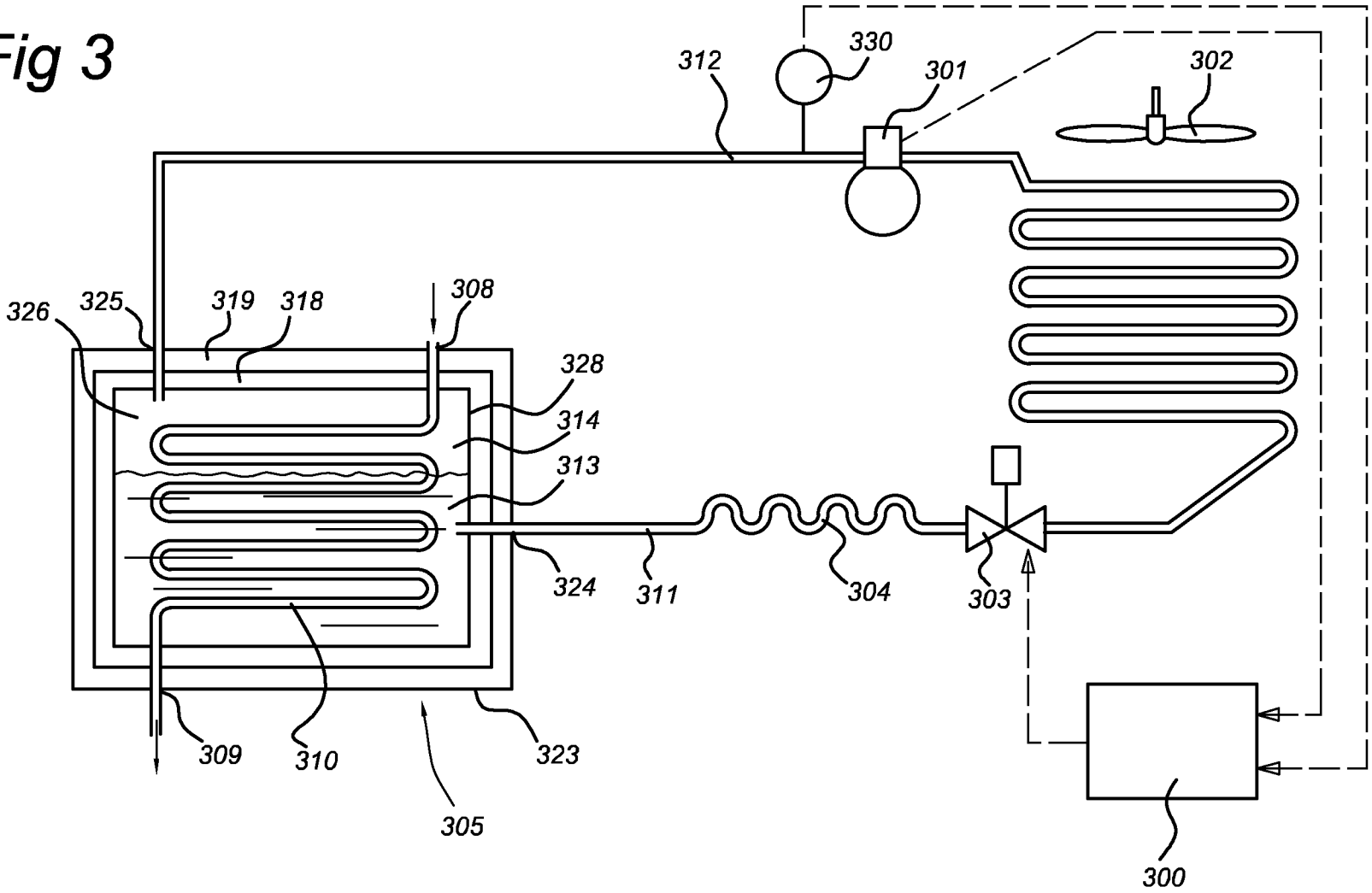
FIG. 3 shows a first embodiment of a refrigeration apparatus.

FIG. 3 shows a diagram of a cooling system capable of circulating refrigerant in a refrigeration cycle. The cooling system comprises a compressor 301, a condenser 302, a controllable valve 303, an expansion device 304, and an evaporator 305. These components 301, 302, 303, 304, 305 are fluidly connected to form the refrigeration cycle. Many different implementations of the compressor, condenser, valve, expansion device, and evaporator are known in the art. For example, the valve 303 and the expansion device 304 may be combined by means of an expansion valve.

In the following, the evaporator 305 will be described in greater detail. It will be noted that in FIG. 3, the compressor 301, condenser 302, valve 303, and expansion device 304 are drawn as symbols to indicate that any suitable device can be used. However, the evaporator 305 has been drawn in greater detail to illustrate certain aspects thereof. Nevertheless, it will be understood that the shown evaporator 305 is only an example and may be replaced by another suitable type of evaporator, such as one of the other types of evaporators disclosed herein.

The evaporator 305 shown in FIG. 3 has a vessel 323 with an inner space 326 bounded by an inner surface 328 of a vessel wall 318. In the exemplary embodiment, an optional isolating layer 319 covers the vessel wall 318 to provide thermal insulation. The vessel 323 comprises an inlet 324 to transport refrigerant into the inner space 326 and an outlet 325 to transport refrigerant out of the inner space 326. To provide the function of an evaporator, the refrigerant is kept under pressure in the inner space 326 and is partially in liquid phase 313 and partially in gaseous phase 314. A tube portion 310 is disposed inside the inner space 326. The outside surface of the tube portion 310 may be in direct contact with the refrigerant 313, 314 to allow efficient heat exchange. A first end 308 of the tube portion 310 is fixed to a first orifice of the vessel 323 and a second end 309 of the tube portion 310 is fixed to a second orifice of the vessel 323 to enable fluid communication into and/or out of the tube portion 310 through the first orifice and the second orifice. More such tube portions and orifices may be provided, for example to allow a plurality of fluids to be cooled in separate tubes. A part of the tube portion 310 is shown to be immersed in the liquid refrigerant 313. Also, a part of the tube is shown to be above the level of liquid refrigerant, surrounded by gaseous refrigerant 314. In use, the liquid refrigerant 313 vaporizes due to heat exchange between the refrigerant 313 and the fluid inside the tube portion 310.

The vessel 323 shown in FIG. 3 does not have a toroid shape (cf. FIG. 2A) but a rectangular shape. The tube 310 makes several turns inside the chamber 326. Otherwise, the evaporator may function similar to the evaporator shown in FIG. 2A and 2B. The orifices may enclose the tube ends 308, 309 such that no refrigerant can enter or leave the inner space through the orifice, and no other fluids from the exterior of the vessel 323 may enter through the orifice into the inner space 326. However, fluid exchange into and out of the tube portion 310 is made possible. Further, the inlet 324 and outlet 325 of the vessel 323 are connected to tubing 311, 312 to transport the refrigerant from the expansion device 304 into the inner space 326 and from the inner space 326 to the compressor 301. The inlet 324 as shown is located below the level of liquid refrigerant. However, the inlet 324 may also be located above the level of liquid refrigerant in other embodiments. The outlet 325 may be located at the top side of the inner space 326, or at least above a level of liquid refrigerant inside the inner space. This way, liquid refrigerant may be prevented from reaching the compressor 301. However, the outlet may also be located below the level of liquid refrigerant in alternative implementations. It will be noted that when in use, the level of liquid refrigerant may vary and the liquid refrigerant may spread throughout the vessel 323 while bubbles of gaseous refrigerant move upwardly.

As mentioned above, the evaporator 305 may be replaced by any other suitable type of evaporator. In the following, it is described how the flow of refrigerant through the refrigeration cycle may be controlled by means of a controllable valve 303. This concept may also be applied to a refrigeration apparatus having another kind of evaporator. In the configuration shown in FIG. 3, this controllable valve 303 is positioned between the condenser 302 and the expansion device 304. Also, a sensor 330 is provided at the inlet of the compressor 301 to measure a property of the refrigerant that enters the compressor 301. This property may be temperature or pressure, for example.

The valve 303 may be controlled between an open and a closed position, wherein in the open position refrigerant can flow from the condenser 302 through the expansion device 304 to the evaporator 305, and in the closed position refrigerant cannot flow from the condenser 302 to the evaporator 305

The apparatus further comprises a controller 300. This controller may comprise, for example, a suitable microcontroller or processor (not shown) and a memory (also not shown) for storing a software program with instructions that the microcontroller or processor is configured to execute. Alternative implementations of controller 300 are also possible, for example by means of an FPGA or a dedicated electronic circuit.

The sensor 330 is operatively connected to the controller 300 in wired or wireless fashion so that values indicative of the measured property are regularly sent from the sensor 330 to the controller 300. The controller 300 receives the information about the measured property and uses the information to control the valve 303. Also, the compressor 301 sends information about its current working capacity to the controller 300, which receives this information. This is indicated by means of dashed or broken lines in FIG. 3. The information about the property received from the sensor 330 can be used to determine, for example, a pressure in a first part of the refrigeration cycle, which first part extends from the outlet of the expansion device 311 to the inlet of the compressor 301, and which includes the evaporator 305. The information about the working capacity of the compressor 301 may be used by the controller 300 to estimate a pressure difference between the outlet and the inlet of the compressor 301. Using the pressure in the first part of the refrigeration cycle and said pressure difference, the controller 300 can compute an estimation of the pressure in a second part of the refrigeration cycle, which second part extends from the outlet of the compressor 301 to the inlet of the expansion device 304 and which includes the condenser 302. The pressure difference can also be used to compute the flow of refrigerant through the expansion device 304. Thus, an estimation of both the flow of refrigerant into the condenser 302 and the flow of refrigerant out of the condenser 302 can be computed. This allows the estimating of the amount of refrigerant inside the condenser 302 (or the amount of refrigerant inside the second part of the refrigeration cycle).

The controller 300 can be programmed with a set point for the amount of refrigerant inside the condenser 302 (or the amount of refrigerant inside the second part of the refrigeration cycle). If the estimated amount of refrigerant is above the set point, the controller 300 may issue a control command to open the valve 303. If the estimated amount of refrigerant is below the set point, the controller 300 may issue a control command to close the valve 303. In certain embodiments, if the estimated amount of refrigerant is close to the set point, the controller 300 may control the valve to assume a position between the fully closed or fully open position, so that the valve has a small or intermediate opening.

Figure 4:
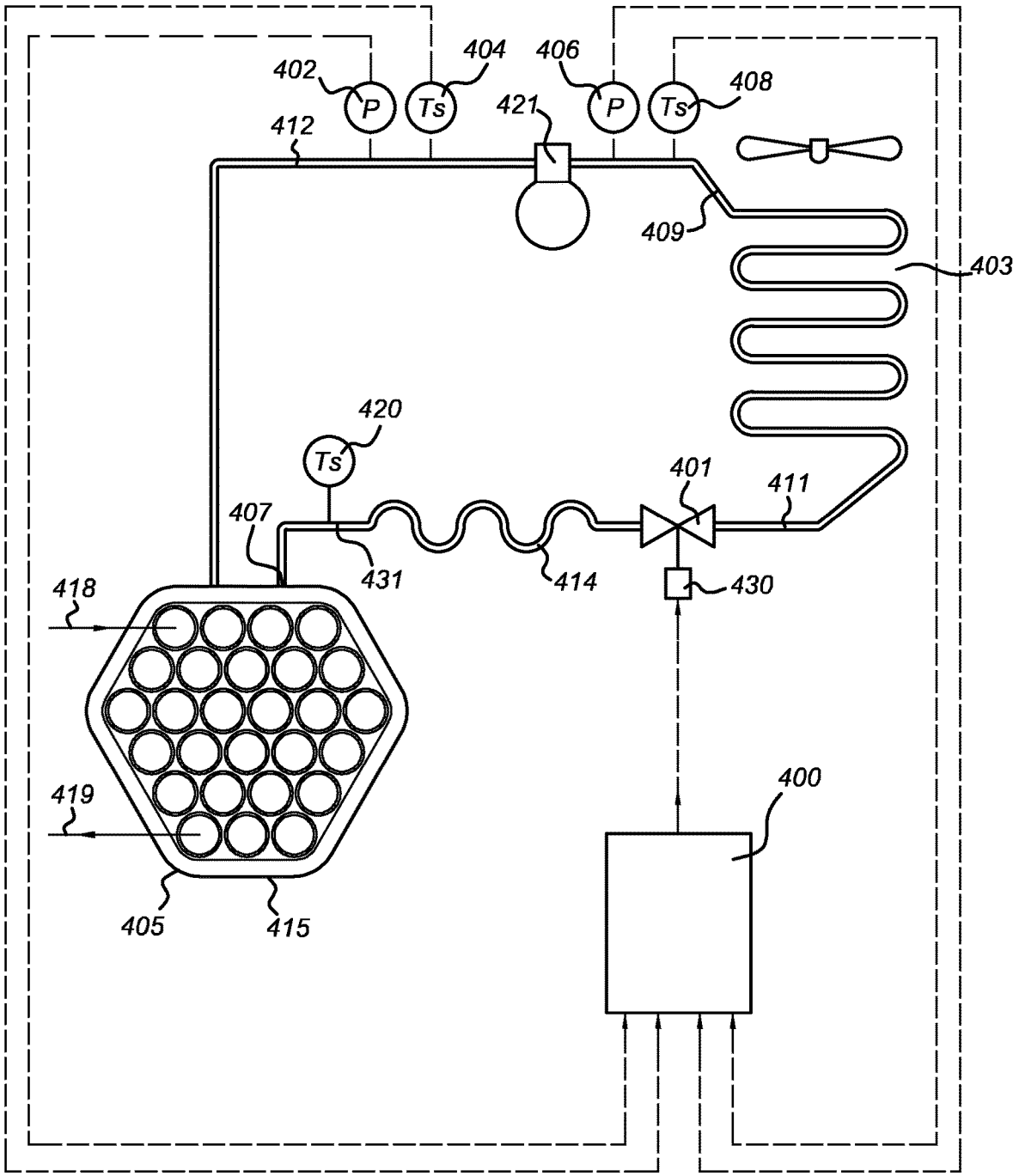
FIG. 4 shows a second embodiment of a refrigeration apparatus.

FIG. 4 shows a diagram of a cooling system capable of circulating refrigerant in a refrigeration cycle. The refrigerating system comprises an evaporator 405, a compressor 421, a condenser 403, a controller 400, a valve 401, and an expansion device 414. Also illustrated are a first pressure sensor 402, a first temperature sensor 404, a second pressure sensor 406 and a second temperature sensor 408. The evaporator 405 may comprise a vessel 415, as presented in analogous form in FIG. 2A-2B or in FIG. 3, with fluid input tube 418 and fluid output tube 419. Alternatively, the evaporator 405 may be any other suitable evaporator known in the art.

The refrigerating system may further comprise a suction line 412. One of the ends of the suction line 412 may be fluidly connected to an outlet of the evaporator 405 and arranged to allow the flow of refrigerant out of the evaporator 405 towards the compressor 421. The other end of the suction line 412 may be further operatively connected to the compressor 421. The compressor 421 may be arranged to cause the flow of the refrigerant from the evaporator 405 to the compressor 421 through the suction line 412. The compressor 421 may be arranged to compress the refrigerant received from the suction line 412. The refrigerating system may further comprise a discharge line 409 fluidly connecting the compressor 421 to the condenser 403 and arranged to allow the flow of the compressed refrigerant from the compressor 421 to the condenser 403. The condenser 403 may be arranged to condense the compressed refrigerant received from the compressor 421. The condenser 403 may be any suitable condenser known in the art.

The refrigerating system may further comprise an output line 411 fluidly connecting the condenser 403 to the controllable valve 401. The refrigerating system may further comprise a line 431 fluidly connecting the valve 401 to the evaporator 405. The valve 401 may comprise a valve member 430, which can be moved to open and close the valve. The valve 401 may be a solenoid valve, a ball valve or any other suitable valve. The valve member 430 of the valve 401 may be arranged to be controlled by the controller 400 between an open and a closed position. The open position of the valve 401 may allow the flow of refrigerant from the condenser 403 to the evaporator 405 via the expansion device 414. The closed position of the valve 401 may prevent the flow of refrigerant from the condenser 403 to the evaporator 405. The expansion device 414 may be fluidly connected between the valve 401 and the evaporator 405. The expansion device 414 may comprise, for instance, a capillary tube. The expansion device 414 may be an expansion valve. The valve 401 may also provide the function of an expansion device, and therefore the expansion device 414 may be integrated with the valve 401. The expansion device 414 may be any kind of suitable expansion device.

The first pressure sensor 402 and the first temperature sensor 404 are arranged, respectively, to measure the pressure and the temperature in the suction line 412. The second pressure sensor 406 and the second temperature sensor 408 may be arranged, respectively, to measure the pressure and the temperature in the discharge line 409. The first pressure sensor 402 and the first temperature sensor 404 may be arranged to measure the pressure and the temperature at any point of the suction line 412. Preferably, the first pressure sensor 402 and the first temperature sensor 404 are arranged to measure the pressure and the temperature of the suction line 412 at a point of the suction line 412 close to the compressor 421. As an alternative, the first pressure sensor 402 and/or the first temperature sensor 404 may be arranged, respectively, to measure the pressure and the temperature in the line 431 between the expansion device and the evaporator. The second pressure sensor 406 and the second temperature sensor 408 may be arranged to measure the pressure and the temperature at any point of the discharge line 409. Preferably, the second pressure sensor 406 and the second temperature sensor 408 are arranged to measure the pressure and the temperature of the discharge line 409 at a point of the discharge line 409 close to the condenser 403. As an alternative, the second pressure sensor 406 and/or the second temperature sensor 408 may be arranged, respectively, to measure the pressure and the temperature in the output line 411 of the condenser 403. The first pressure sensor 402 and the second pressure sensor 406 may be any kind of suitable pressure sensor and they may be connected respectively to the suction line 412 and the discharge line 409 in any suitable way that allows to measure the pressure of the fluid passing respectively through the suction line 412 and the discharge line 409. The first temperature sensor 404 and the second temperature sensor 408 may be any kind of suitable temperature sensor and they may be respectively connected to the suction line 412 and the discharge line 409 in any suitable way that allows to measure the temperature of the fluid (refrigerant) passing respectively through the suction line 412 and the discharge line 409.

An example of a pressure sensor that may be used is a pressure transmitter (PT) that converts a pressure into a linear electrical output signal. An example implementation of a pressure transmitter may comprise a piezo resistive chip enclosed in an oil capsule. An example of a temperature sensor is a negative temperature coefficient (NTC) thermistor. These examples of pressure sensors and temperature sensors are known in the art per se. Other types of pressure sensors and temperature sensors can also be used in the different implementations disclosed herein.

The first pressure sensor 402, the first temperature sensor 404, the second pressure sensor 406 and/or the second temperature sensor 408 may be connected to the controller 400 in wired or wireless fashion such that the controller 400 may regularly receive signals indicative of a first temperature measured by the first temperature sensor 404, a second temperature measured by the second temperature sensor 408, a first pressure measured by the first pressure sensor 402, and/or a second pressure measured by the second pressure sensor 406.

The controller 400 may control the valve 401 between the open and the closed position (or an intermediate position) based on the first temperature measured by the first temperature sensor 404, the second temperature 408 measured by the second temperature sensor, the first pressure measured by the first pressure sensor 402, and/or the second pressure measured by the second pressure sensor, by means of a corresponding control signal.

The controller 400 may determine the density of the refrigerant at the suction line 412 based on the first pressure measured by the first pressure sensor 402, for example by using a thermodynamic table of saturated values for the particular substance used as the refrigerant. The controller 400 may also determine the density of the refrigerant at the suction line 412 of the compressor 421 based on the first temperature measured by the first temperature sensor 404, for example by using the thermodynamic table.

The controller 400 may further receive other inputs, for instance information about the capacity (power) at which the compressor 421 is currently working. The compressor 421 may comprise cylinders. Part of the cylinders of the compressor 421 may be activated or deactivated in order to control the capacity of the compressor. The controller 400 may further receive information of the speed at which the compressor 421 is working (for example in number of revolutions per unit of time), the number of activated or deactivated cylinders, etc. Also, the controller 400 may receive information about the volume of refrigerant displaced by the compressor 421 in one revolution. The controller 400 may receive or calculate also the amount of time that the compressor 421 has been running. The controller may calculate the volume of refrigerant that has been displaced by the compressor 421 in a given time interval based on the volume of refrigerant displaced by the compressor 421 in one revolution, the length of the time interval, and the speed at which the compressor 421 is working in revolutions per time unit. Other manners to determine the volume of the refrigerant that has passed the compressor 421 may be used alternatively. For example, the displacement of refrigerant per second may be determined based on certain settings of the compressor 421. To that end, a look-up table that maps different settings of the compressor to different displacement capacities may be used.

The controller 400 may calculate the mass flow of refrigerant into the condenser 403 based on the volume of refrigerant displaced by the compressor 421 and the mass density of the refrigerant at the suction line 412.

The controller 400 may use all or some of the other inputs for controlling the valve 401 between an open and a closed position.

The controller 400 may calculate the mass flow of refrigerant going out of the condenser 463 based on the throughput of refrigerant through the expansion device 414. This throughput may be known by testing or by design of the expansion device 414. The throughput may depend on the pressure difference between the output line 411 of the condenser 411 towards the valve 401 and expansion device 414 and the line 431 from the expansion device 414 to the evaporator 405. An estimate of these pressures is the pressure obtained from the measurements made by the sensors 402, 404, 406, 408.

The controller 400 may further receive information about the capacity of a fan of the condenser 403 and the working surface of said fan, i.e., the surface of the tube inside of the condenser 403 through which the refrigerant flows. This can provide information about how quickly the refrigerant condenses inside the condenser 403.

The controller 400 may calculate the mass flow of refrigerant going into the condenser 403 and the mass flow of refrigerant going out of the condenser 403. The controller 400 may calculate the mass flow of refrigerant going into the condenser 403 by calculating the displacement of the compressor 421. This can be calculated based on the working capacity of the compressor 421. The working capacity of the compressor 421 may be determined from current settings of the compressor 421 and specifications thereof. For example, the working capacity in terms of displaced volume per time unit may be determined from the current settings of the compressor 421 using a look-up table. The displaced mass per time unit may be computed based on the displaced volume per time unit and the mass density of the displaced refrigerant.

Also, the controller 400 may calculate the mass flow of refrigerant going out of the condenser 403 based on the pressure of the refrigerant on both sides of the expansion device 414 and the properties of the expansion device 414. For example, the volume of refrigerant that flows through the expansion device 414 per time unit may be looked up in a look-up table that maps pressure difference to volume per time unit.

The mass density of the refrigerant may be determined from a thermodynamic look-up table based on the pressure or the temperature. The thermodynamic table provides the relationship between, among others, temperature, pressure, and mass density of the refrigerant in saturated condition. Since the thermodynamic table allows to determine the pressure from a measured temperature, and to determine the temperature from a measured pressure, the sensors 402, 404, 406, 408 used may be temperature sensors or pressure sensors. By using both temperature and pressure sensors, the accuracy may be improved and/or special circumstances, such as leakage or superheating, may be detected by the controller 400.

By keeping track of the mass flow into the condenser 403 and the mass flow out of the condenser 403, the mass of refrigerant inside the condenser 403 may be computed by adding the mass that flows into the condenser 403 and subtracting the mass that flows out of the condenser 403.

The controller 400 may control the valve 401 to open or close based on the mass of refrigerant inside the condenser 403. The controller 400 may open the valve 401 to allow the flow of refrigerant from the condenser 403 to the evaporator 405 if the mass of refrigerant in the condenser 403 exceeds a first predetermined threshold value. The controller 400 may close the valve 401 to prevent the flow of refrigerant from the condenser 403 to the evaporator 405 if the mass of refrigerant in the condenser is below a second predetermined threshold value. Herein, the first predetermined threshold value may be larger than (or equal to) the second predetermined threshold value.

In certain embodiments, the cooling system may comprise a third temperature sensor 420 arranged to measure the temperature at the line 431 from the expansion device 414 to the inlet 407 of the evaporator 415. If the temperature measured by the third temperature sensor 420 increases compared to the temperature measured by the first temperature sensor 404, which is in this example located at the outlet of the evaporator 415, this is an indication that the refrigerant in the output line 411 of the condenser 403 may not be liquid, but gaseous. In such a case, the controller 400 may be configured to close the valve 401. Additionally, the controller 400 may be configured to reset the value representing the mass of refrigerant inside the condenser 403 to a default value (for example zero or a value based on the mass density of gaseous refrigerant given the pressure condition inside the condenser 403) if overheating is detected. This allows a well-defined starting value for the mass of refrigerant inside the condenser 403 to be obtained.

The controller 400 may calculate the working capacity of the compressor 421 based on the electrical current that the compressor 421 is consuming (for instance with a transformer). This current is a good indication of the working capacity of the compressor 421. Current values may be mapped to working capacity values by means of a suitable look-up table. In other embodiments, sensor 420 may be deviced as a pressure sensor (cf. below).

FIG. 5 shows a flowchart of steps which may be performed by the controller 300 or 400 during operation. At step 501 the method starts. In step 502, the controller 300 or 400 calculates the density of refrigerant in the first part of the refrigeration cycle, for example at the suction point of the compressor 301, 421. More specifically, the density of refrigerant near the suction point of the compressor 301, 421 may be calculated. The suction pressure 512 and/or the suction temperature 513, which may be measured by sensors 330, 402, 404, may be used as relevant input values, for example. The table of saturated values 511 may be used as a reference in the computation.

In step 503, the controller 300, 400 calculates the density of the refrigerant in the second part of the refrigeration cycle, in particular at the condensation point, near the outlet of the condenser 302, 403. The discharge pressure 514 of the compressor 301, 421 may be used as a relevant input value. Also, the temperature 515 of liquid refrigerant at the outlet of the condenser 302, 403 may be used as a relevant input value. To that end, the temperature sensor 408 may be located in the output line 411 of the condenser 403.

In step 504, the mass flow of refrigerant into the condenser 302, 403 is computed. This computation is based on the calculated density a the suction point of the compressor 301, 421, and on the capacity of the compressor 301, 421 in terms of displaced volume per time unit.

In step 505, the mass flow of refrigerant leaving the condenser 302, 403 is computed. This computation is based on the known throughput of the expansion device 304, 414 in terms of throughput volume per time unit, given the pressure before and after the expansion device 304, 414.

In step 506, the amount of refrigerant inside the condenser 302, 403 is computed. Instead of the amount of refrigerant inside the condenser 302, 403, the amount of refrigerant inside the second portion of the refrigeration cycle may be used, for example. This amount of refrigerant may be computed by starting from a previous amount of refrigerant at a certain time t, adding the amount of refrigerant that has been displaced by the compressor 301, 421 during a time interval from t to t+Δt, wherein Δt is a time duration, which may be for example in the range of 0.01 to 1 second, and subtracting the amount of refrigerant that has passed the expansion device 304, 414 in the time interval from t to t+Δt. The initial value for the amount of refrigerant may be determined in the factory when filling the refrigeration apparatus with refrigerant. Also, in case of superheating, the amount of refrigerant inside the condenser 302, 403 may be reset to zero, for example. It will be noted that the measured pressures and/or temperatures used in steps 502, 503, and 504 relate to the time interval from t to t+Δt.

In step 507, the valve 303, 401 is controlled to assume a position, such as a closed or open position (optionally, intermediate positions may be supported). To that end, the determined amount of refrigerant in the condenser 302, 403 is compared with the set point 516. The value of this set point 516 may be a design parameter of the refrigeration apparatus. If the amount of refrigerant in the condenser 302, 403 is smaller than the set point of the system, the valve 303, 401 is controlled to assume a closed position. If the amount of refrigerant at the outlet of the condenser 302, 403 is higher than the set point of the system, the valve 303, 401 is controlled to assume an open position. More complex control algorithms are also possible. For example, different thresholds may be used for triggering the closing and opening of the valve 303, 401.

In step 508, it is determined whether the process should continue. If it is determined that the process is finished, for example if the refrigeration apparatus is switched off, the process ends in step 510. Otherwise, a delay 509 may be applied so that the controller 300, 400 may be idle for a time period. The duration of this idle time period may be Δt minus the processing time spent for the computations. After the delay, the process is repeated from step 502.

A numerical example will be explained now with reference to FIG. 4. The values mentioned are only examples.

First a set point for the system is calculated. The set point is calculated as the target percentage of the condenser volume in the liquid line 411 of the condenser 403 that is to be filled with liquid refrigerant. The set point may be expressed as a percentage of the volume of the condenser 403, for example. The volume of the space for refrigerant within the condenser 403 may be known or may be calculated based on the working conditions of the condenser 403. This volume of the condenser 403 may be calculated in any suitable way. Also, the density of the refrigerant in the liquid line 411 may be calculated. In this example, the volume of the condenser 403 is 0.8 cubic decimetres. For example, the refrigerant density at the liquid line of the condenser 403 may be determined to be 487.8 gram/litre. The percentage of the condenser volume that is to be filled with liquid refrigerant is selected to be, for example, 4%. From the mass density of the refrigerant at the outlet line 411 of the condenser 403, and the target percentage of the condenser volume that is to be filled with liquid refrigerant, the corresponding target mass of liquid refrigerant at the outlet line 411 of the condenser 403, may be computed and used as a set point for the system. In this case, the target mass of liquid refrigerant is 0.8 cubic decimetres multiplied by 0.04 multiplied by 487.8 gram/litre. This equals to a set point of 15.6 grams.

For example, the controller 400 can be configured to measure the running conditions of the compressor 421 every 1/10 second and to calculate the mass flow into the condenser 403 every 1/10 second. Of course, another suitable time interval can be used alternatively. The controller 400 receives, from sensor 402, the value of the pressure in the suction line 412 and/or the pressure in the line 431 from the expansion device 414 to the evaporator 415, from (pressure) sensor 420, or by means of computation (table look-up) and uses a thermodynamic table to determine the density of the refrigerant at the suction line 412. The controller may also receive signals indicative of the temperature at the suction line 412 (sensor 404) and/or the temperature at the line 431 (temperature sensor 420) and use the reference from the thermodynamic table to determine the density of the refrigerant at the suction line 412.

In a particular example, the temperature in the suction line 412 may be 3 degrees Celsius. The density of the refrigerant at the suction line 412 may be 11.9 grams per liter. This density may be looked up in the thermodynamic table. Using the information about the capacity at which the compressor 421 is running, the controller 400 calculates the displacement of the compressor 421. For example, the displacement of the compressor 421 is 17.9 cubic centimeters per revolution.

The volume of refrigerant displaced by the compressor 421 may be computed, for example, as the displacement of the compressor 421 per revolution, multiplied by the number of revolutions per second of the compressor 421, multiplied by the length of the time interval for which the computation is made. In the example, the number of revolutions per second of the compressor 421 is 51 and the length of the time interval is 0.1 seconds. The volume of refrigerant displaced by the compressor 421 is then 17.9 cubic centimeters per revolution multiplied by 51 revolutions per second multiplied by 0.1 seconds, which results in a volume of refrigerant displaced by the compressor equal to 91.26 cubic centimeters.

Multiplying the volume of refrigerant displaced by the compressor 421 by the density of the refrigerant at the suction line 412 results in the mass flow of refrigerant into the condenser 403.

The controller 400 may measure every 1/10 second, or at another suitable interval, the running conditions at the outlet line 411 of the condenser 403 and may calculate the mass flow out of the condenser 403. The controller 400 may calculate the mass flow out of the condenser 403 using the pressure difference between the refrigerant in the liquid line 411 and the refrigerant in the line 431 from the expansion device 414 to the evaporator 415.

The total amount of refrigerant in the liquid line of the condenser 403 may be updated by adding the mass of refrigerant displaced by the compressor 421 and subtracting the mass of refrigerant that has passed the expansion device 414 from the previous estimate of the amount of refrigerant in the liquid line of the condenser 403.

The controller 400 controls the valve 401 based on the mass of refrigerant stored in the liquid line 411 of the condenser 403. In this example, the set point is 15.60 gram, and the controller 400 opens and closes the valve 401 in order to keep the amount of refrigerant in the condenser close to 15.6 grams.

The examples and embodiments described herein serve to illustrate rather than limit the invention. The person skilled in the art will be able to design alternative embodiments without departing from the scope of the claims. Reference signs placed in parentheses in the claims shall not be interpreted to limit the scope of the claims Items described as separate entities in the claims or the description may be implemented as a single hardware or software item combining the features of the items described.

The invention claimed is:

1. A refrigeration apparatus for refrigerating a fluid, comprising:

a refrigerant;

a compressor (301), a condenser (302), an expansion device (304), and an evaporator (305), fluidly connected to form a refrigeration cycle;

a controllable valve (303) configured to control a flow of the refrigerant from the condenser (302) to the evaporator (305);

at least one sensor (330) configured to measure a property of the refrigerant;

a controller (300) configured to receive from said at least one sensor information about the measured property, use said information to determine an amount of the refrigerant stored in a portion of the refrigeration cycle comprising the condenser (302), and control the controllable valve (303) based on the determined amount of the refrigerant; and the controller (300) is configured to compute a displacement of the refrigerant by the compressor (301) and a throughput of the refrigerant through the expansion device (304), and to compute the amount of refrigerant in the portion of the refrigeration cycle comprising the condenser based on the displacement and the throughput.

2. The apparatus of claim 1, wherein the property comprises at least one of temperature or pressure.

3. The apparatus of claim 1, wherein said at least one sensor comprises:

a first sensor (402, 404) configured to measure a first property of the refrigerant in a first portion of the refrigeration cycle, the first portion of the refrigeration cycle being a portion from an outlet of the expansion device (404) to an inlet of the compressor (421) and the first portion including the evaporator (415).

4. The apparatus of claim 3, wherein said at least one sensor further comprises:

a second sensor (406, 408) configured to measure a second property of the refrigerant in a second portion of the refrigeration cycle, the second portion of the refrigeration cycle being a portion from an outlet of the compressor (421) to an inlet of the expansion device (414) and including the condenser (403).

5. The apparatus of claim 1, wherein the controller (300) is further configured to receive information about a capacity at which the compressor (301) is working and to determine said amount of the refrigerant further based on said information about the capacity at which the compressor (301) is working.

6. The apparatus of claim 5, wherein the information comprises information about a current consumed by the compressor (301) or a setting of the compressor (301).

7. The apparatus of claim 1, wherein the controller (300) is configured to calculate said displacement based on a mass density of the refrigerant at a suction line of the compressor (301) and a working capacity of the compressor expressed as displaced volume per time unit.

8. The apparatus of claim 1, wherein the controller (300) is configured to calculate said throughput based on a difference between a pressure of the refrigerant flowing into the expansion device (304) and a pressure of the refrigerant flowing out of the expansion device (304).

9. The apparatus of claim 1, wherein the controller (300) is configured to control to open the controllable valve (303) to allow the flow of the refrigerant from the condenser (302) to the evaporator (305) if the amount of refrigerant in the portion of the refrigeration cycle comprising the condenser (302) exceeds a first predetermined threshold value, and control to close the controllable valve (303) to prevent the flow of the refrigerant from the condenser (302) to the evaporator (305) if the amount of refrigerant in the portion of the refrigeration cycle comprising the condenser (302) is below a second predetermined threshold value.

10. The apparatus of claim 3, wherein the first sensor (402, 404) is configured to measure the first property of the refrigerant inside the evaporator (415) or in a passage from the evaporator (415) to the compressor (421), and the apparatus further comprises a third sensor (420) configured to measure a third property of the refrigerant in a passage from the expansion device (414) to an inlet (407) of the evaporator (415); and the controller (400) is configured to determine an overheating condition based on the first property and the third property, and to control the controllable valve (401) also based on the determined overheating condition.

11. The apparatus of claim 1, wherein the portion of the refrigeration cycle comprising the condenser (302) is a portion that extends from an outlet of the compressor (301) to an inlet of the expansion device (304) and including the condenser (302).

12. The apparatus of claim 1, wherein the controllable valve (303) is at least a part of the expansion device (304).

13. A method of operating the refrigeration apparatus of claim 1, the method comprising:

using the measured property to determine (506) an amount of the refrigerant stored in a portion of the refrigeration cycle comprising the condenser, and controlling (507) the controllable valve based on the determined amount of the refrigerant.

* * * * *